United States Patent [19]

Earl

[11] Patent Number: 4,770,318

[45] Date of Patent: Sep. 13, 1988

[54] INTERLOCKING LID AND ASSOCIATED CONTAINER

[75] Inventor: John W. Earl, Stockbridge, Mich.

[73] Assignee: Dart Container Corporation, Mason, Mich.

[21] Appl. No.: 431,686

[22] Filed: Sep. 30, 1982

[51] Int. Cl.[4] ..... B65D 41/16

[52] U.S. Cl. ..... 220/307; 220/366

[58] Field of Search ..... 220/366, 307

[56] References Cited

U.S. PATENT DOCUMENTS

| | | | |
|---|---|---|---|
| 3,080,993 | 3/1963 | Livingstone | 220/307 |
| 3,137,409 | 6/1984 | Davis | 220/307 |
| 3,173,571 | 3/1965 | Cserny et al. | 220/366 |
| 3,193,132 | 7/1965 | Gray | 220/307 |
| 3,381,872 | 5/1968 | Holder et al. | 220/366 |
| 3,399,803 | 9/1968 | Oglevee et al. | 220/300 |
| 3,460,711 | 8/1969 | Al-Roy | 220/307 |
| 3,651,981 | 3/1972 | Kinney | 220/366 |
| 3,672,536 | 6/1972 | Kinney et al. | 220/366 |
| 3,791,514 | 2/1974 | Watanabe | 220/307 |
| 3,888,347 | 6/1975 | Kramer | 220/366 |
| 4,118,616 | 10/1978 | Wittkamp et al. | 220/307 |
| 4,206,845 | 6/1980 | Christian | 220/366 |
| 4,206,854 | 6/1980 | Takami | 220/366 |
| 4,252,268 | 2/1981 | Haire | 220/366 |
| 4,301,939 | 11/1981 | Pupp | 220/307 |
| 4,308,970 | 1/1982 | Von Holdt | 220/307 |
| 4,397,404 | 8/1983 | Blanchette | 220/307 |
| 4,446,986 | 5/1984 | Bowen et al. | 220/307 |

FOREIGN PATENT DOCUMENTS

| | | | |
|---|---|---|---|
| 530217 | 11/1953 | Italy | 220/307 |

*Primary Examiner*—Joseph Man-Fu Moy

*Attorney, Agent, or Firm*—Miller, Morriss and Pappas

[57] ABSTRACT

An interlocking lid is provided which is adapted for interlocking engagement with an associated container having an upper peripheral rim edge portion defining an opening therein. The circular interlocking lid is provided with annular lid interlock means along the outer peripheral edge of the downwardly depending central portion thereof which are adapted to matingly engage corresponding annular container interlock means provided along the upper inner surface of the container proximate to the upper peripheral rim edge portion thereof when the lid is placed in press-fitted engagement with the container so as to effect closure thereof. Another embodiment of the interlocking lid is provided with a plurality of spaced-apart vent channels along the outer peripheral edge thereof. Upon press-fitted interlocked engagement of the lid with the container, the vent channels of the lid cooperate with the upper peripheral rim edge portion of the container to form vent openings for the closed container.

3 Claims, 5 Drawing Sheets

INTERLOCKING LID AND ASSOCIATED CONTAINER

This invention relates to an interlocking lid and an associated container having an upper peripheral rim edge portion defining an opening therein. More specifically, this invention relates to a circular lid provided with annular interlock means along the outer peripheral edge of the downwardly depending central portion thereof which are adapted to matingly engage corresponding annular interlocking means provided along the upper inner surface of the container proximate to the upper peripheral rim edge portion thereof when the lid is placed in press-fitted engagement with the container so as to effect closure thereof.

Another embodiment of the interlocking lid is provided with a plurality of spaced-apart vent channels provided along the outer peripheral edge thereof. Upon press-fitted interlocked engagement of the lid with the container, the vent channels of the lid cooperate with the upper peripheral rim edge portion of the container to provide vent openings for the closed container.

It is therefore an object of this invention to provide an interlocking lid having annular interlocking means which are adapted to matingly engage corresponding annular interlocking means provided on the upper inside surface of the associated container so as to retain the lid in locked covering engagement with the container.

A further object of this invention is to provide an interlocking lid and associated container having corresponding interlocking means which matingly engage so as to provide positive covering locking engagement of the lid to the container without regard to various shrinkage rates between "old" lids and "new" containers.

Yet another object of this invention is to provide an interlocking lid and associated container having correspoinding integral interlocking means whereby the foamed annular beads forming the interlocking means provided on the lid and associated container respectively are not damaged or deformed in use so as to permit repeated liddings and deliddings thereof.

A still further object of this invention is to selectively provide an interlocking lid having vent channels and an associated container which cooperate to define multiple vent openings when the lid is in its closed interlock position in association with the container.

Other objects and advantages found in the construction of the invention will be apparent from a consideration of the following specification in connection with the appended claims and the accompanying drawings.

IN THE DRAWINGS

SPECIFIC DESCRIPTION

Figure 1:
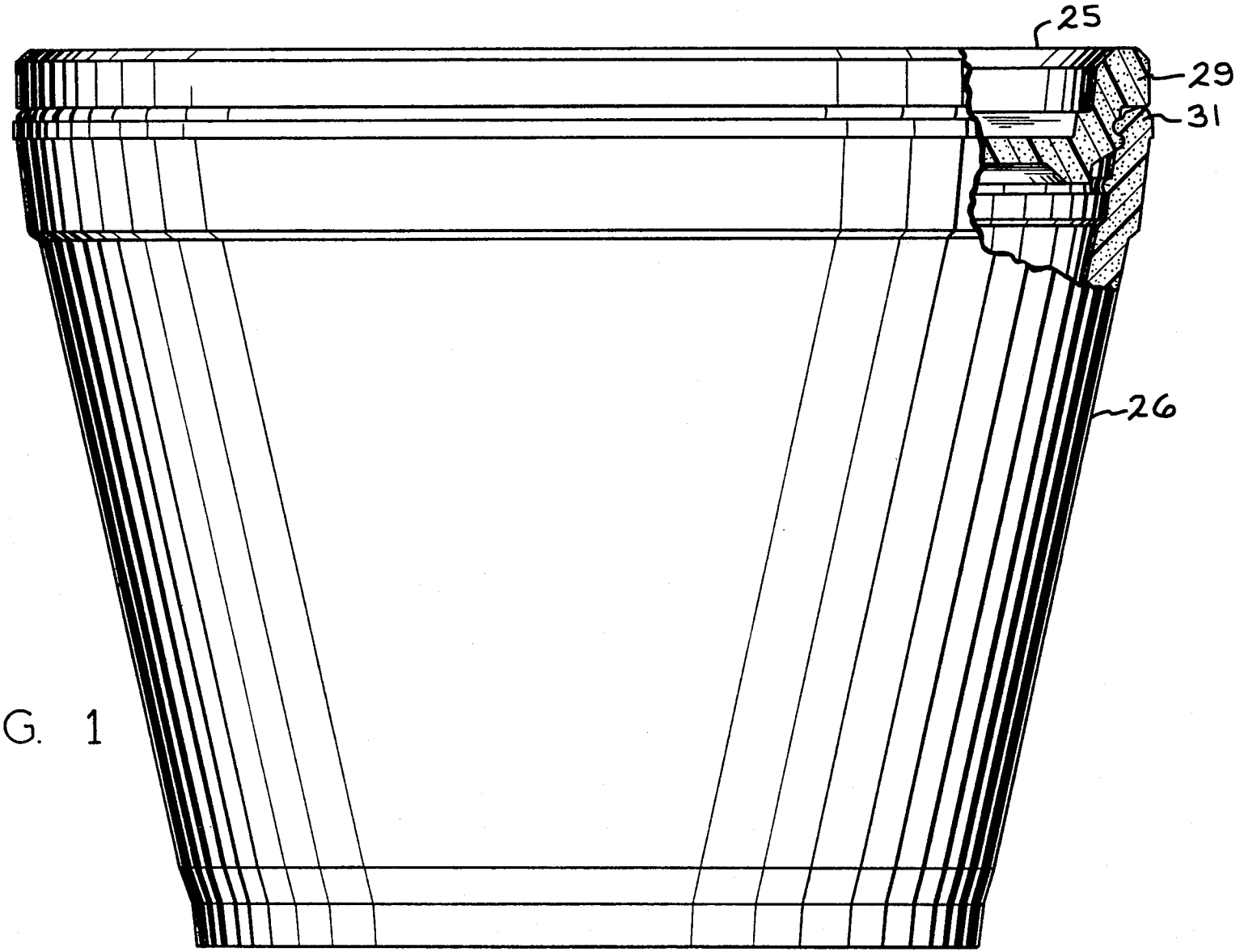
FIG. 1 is a side elevational view of the interlocking lid and associated container with a portion thereof broken away to show the cross-sectional mating configuration of the interlocked portions of the lid and container.

As shown generally in the drawings and more specifically in FIG. 1, an interlocking lid 25 is provided for interlocked covering mating engagement with an associated container 26.

Figure 2:
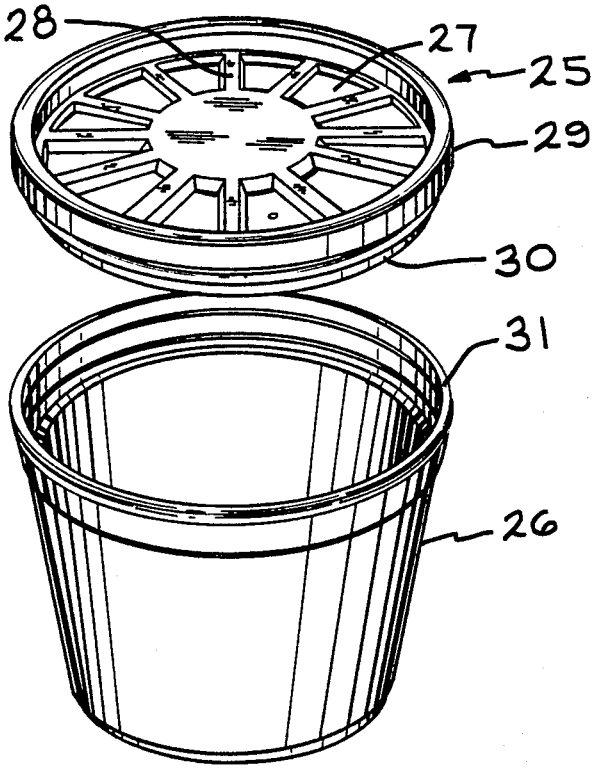
FIG. 2 is a perspective view of the interlocking lid and the associated container spaced apart therebelow.
Figure 3:
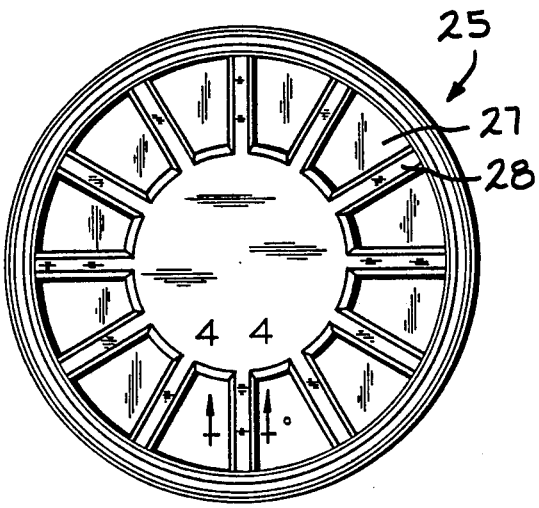
FIG. 3 is a top view of the lid.
Figure 5:
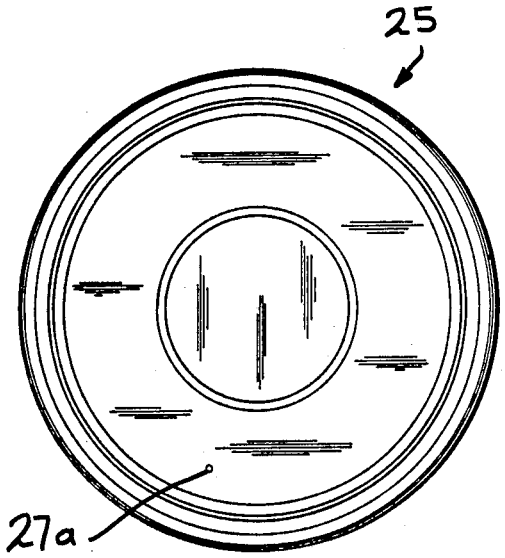
FIG. 5 is a bottom view of the lid.
Figure 4:
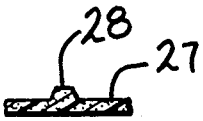
FIG. 4 is a partial cross-sectional view of the lid taken on line 4—4 of FIG. 3.
Figure 6:
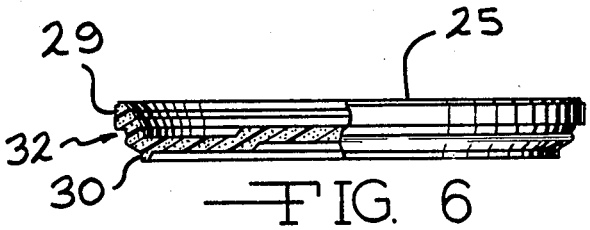
FIG. 6 is a side elevational view of the lid with a portion thereof broken away to show the cross-sectional configuration thereof.
Figure 7:
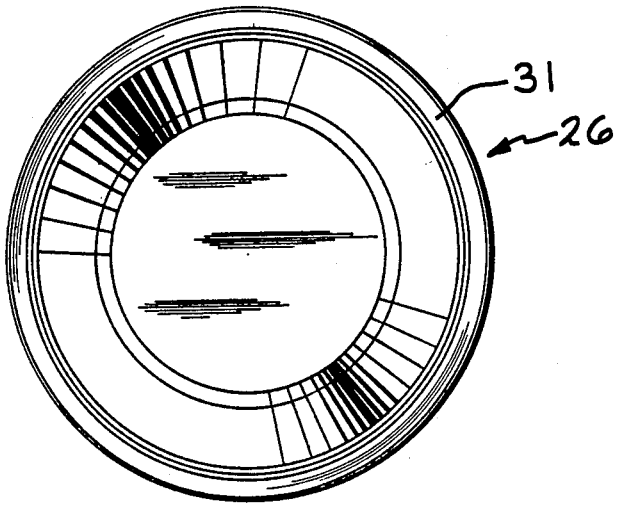
FIG. 7 is a top view of the container.
Figure 8:
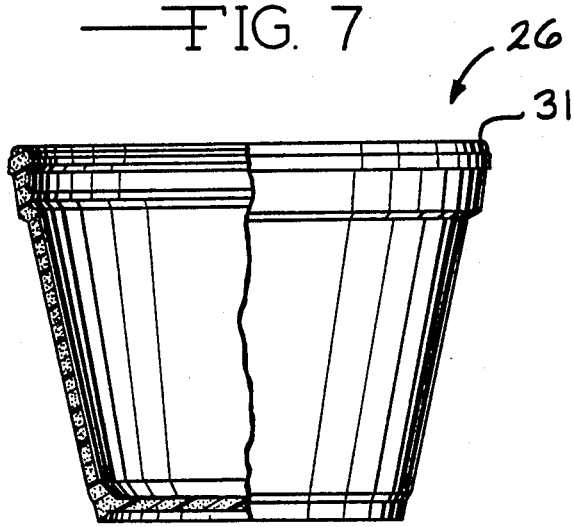
FIG. 8 is a side elevational view of the container with a portion thereof broken away to show the cross-sectional configuration thereof.
Figure 9:
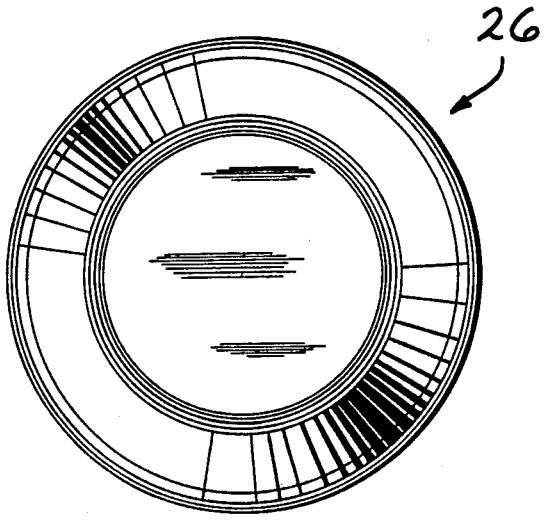
FIG. 9 is a bottom view of the container.

As shown in FIG. 2, the lid 25 has a circular configuration with a generally flat depressed central portion 27. The depressed flat central portion 27 is provided with a plurality of radially extending strengthening rubs 28 provided therein. However, it is within the scope of the invention to provide a lid having a central body portion of any desired configuration depending on the requirements of the manufacture and/or customer utilizing the lid. The lid has a vent hole **27*a*** therethrough.

The lid 25 is provided with an outwardly extending annular lip flange 29 extending from the upper peripheral edge thereof. The lid 25 has a central downwardly depending body portion 30 which is configured to matingly engage the upper inner surface of a container 26 proximate to the upper peripheral lip edge or rim 31 thereof in a press-fit relationship so as to effect covering closure of the container 26.

The outer peripheral edge of the downwardly depending body portion 30 of the lid 25 comprises a substantially vertical outer peripheral edge surface havign a slight downwardly and inwardly inclined conical configuration adapted to matingly engage the corresponding upper inner surface of the container 26 upon which the lid 25 is selectively mounted.

In the preferred lid embodiment of the invention, first lid interlock means 32 are provided on the inclined outer peripheral edge surface of the downwardly depending body portion 30 of the lid 25 and are comprised of a lower annular lid raised bead portion 33 and an upper annular lid depressed groove or recess portion 34 immediately adjacent to and above the raised bead portion 33. As shown generally in the drawings and particularly in FIGS. 1, 10 and 11, the lower raised lid bead portion 33 and the upper depressed lid groove portion 34 combine to form the first lid interlock means 32 having an elongate serpentine "S" configuration when viewed in cross-section.

In the preferred container embodiment of the invention, second container interlock means 35 are provided on the upper inner surface of the container 26 proximate to the periphral lip edge rim 31 thereof and is provided with a corresponding upper annular raised container bead portion 36 and a lower annular container groove or recess portion 37 immediately adjacent to and below the annular riased bead portion 36. The upper annular raised container bead portion 36 and the lower container groove portion 37 combine to form the second container interlock means 35 having a corresponding elongate serpentine "S" configuration when viewed in cross section. Thus formed, the second container interlock means 35 are adapted to matingly engage the corresponding first lid interlock means 32 when the lid 25 is placed in covering engagement on the container 26.

Figure 11:
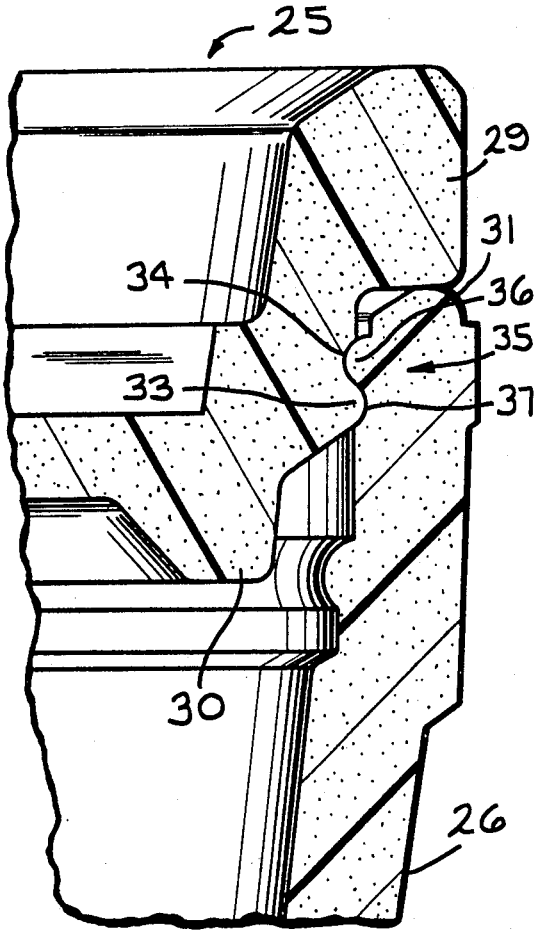
FIG. 11 is an enlarged partial schematic cross-sectional view of the lid and associated container in their interlocked position.

As shown in FIGS. 1 and 11, when the lid 25 is selectively pressed into position in covering engagement with the container 26, the downwardly depending body portion 30 extends downwardly into the opening of the container 26 so as to effect closure thereof. With the lid 25 thus positioned, the annular lip flange 29 extends over the peripheral lip or rim 31 of the container 26 in abutting contact therewith so as to complete closure of the container.

As shown in FIG. 11, the positive interal interlock or latching covering closure of the lid 25 on the container 26 is effected by the dowardar movement of the lower annular lid bead portion 33 over the upper annular container bead portion 36 as the lid 25 is pushed downwardly into its closed position on the container 26. As the lid 25 is pressed into its full closure position on the container 26, the lower annular lid bead portion 33 moves into mating engagement witht he lower container groove portion 37. Simultaneously, the upper container bead portion 36 moves into mating engagement with the upper annular lid groove portion 34, thereby completing the positive interlock of the lid 25 with the container 26 so as to complete the positive locking or latching closure thereof.

The provision of the corresponding upper annular lid groove 34 and the lower annular container groove 37 not only enhances the positive interlock of the lid to container, but also contributes greatly to the longevity of the overall interlock means as discussed above. It has been found that when the respective upper lid groove 34 and/or lower container groove 37 are not utilized, the corresponding annular lid bead member 33 and annular container bead member 36 are crushed or deformed against the corresponding flat lid or container surfaces after movement over each other into their fully closed positions as previously described. The crushing or deforming of the lid bead member 33 and container bead member 36 occurs because in their preferred embodiments the lid and container are formed from easily deformable foamed plastic well known in the trade. Thus, when each annular lid bead member 33 and container bead member 36, respectively matingly move into their corresponding annular container groove 37 and annular lid groove 34, respectively, such crushing or deforming is generally avoided, thus allowing the lid to be lidded and delidded many times while effectively maintaining its interlock capabilities in relationship to the container upon which it is mounted.

Another important advantage of the foregoing elongate serpentine "S" curve interlock cross-sectional configuration between the lid 25 and container 26 is that such interlock configuration eliminates the problem that has existed due to the "shrinkage" which normally occurs with stored lids and containers. In the past, the difference in "shrinkage" between "aged" lids and "new" containers, or vice versa, has resulted in loose fitting lids or improperly fitting lids as the case may be. Thus, the new interlock means having a serpentine "S" configuration insures proper fit and closure regardless of "age", i.e., shrinkage, of the lids and containers.

Figure 12:
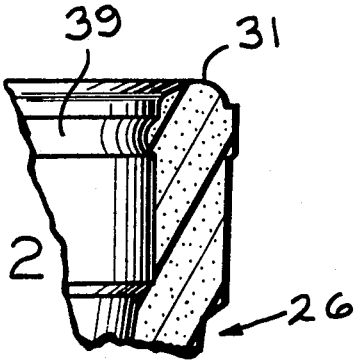
FIG. 12 is a partial schematic cross-sectional view of a modified container showing the modified annular interlock means on the inside surface thereof proximate to the upper peripheral edge thereof.
Figure 14:
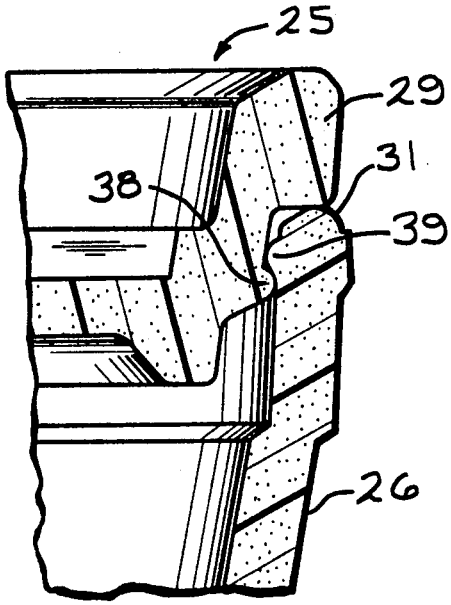
FIG. 14 is an enlarged partial schematic cross-sectional view of another modified embodiment of the interlocking lid and associated container in their interlocked position.

As noted in FIGS. 12 and 14 of the drawings, it is within the scope of the invention to provide a modified lid 25 and corresponding modified container 26 provided with corresponding annular lid bead member 38 and annular container bead member 39, respectively, without any corresponding annular groove portions. In this embodiment of the invention, the closure interlock occurs by movement of the annular lid bead 28 over and just below the corresponding annular container bead 39 as the lid 25 moves into its fully closed position on the container 26.

Figure 10:
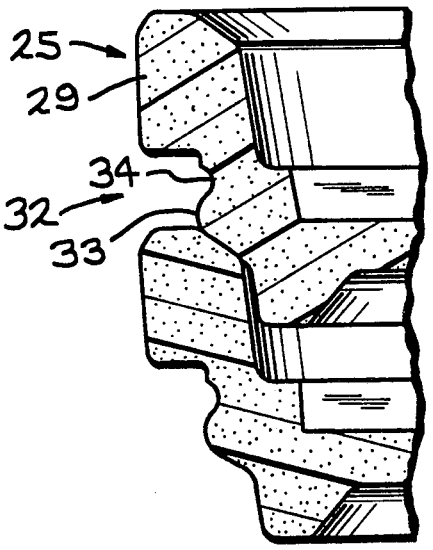
FIG. 10 is a partial schematic cross-sectional view showing a pair of the lids in a nestably stacked relationship.

Yet another embodiment of the invention is to provide a modified lid 25 having both the lower annular lid bead 33 and upper annular lid groove 34, as shown in FIG. 10, in association with a container 26 as shown in FIG. 12, which is provided with only the corresponding annular container bead 39 which moves over the annular lid bead 33 into mating engagement with the upper lid groove 34. Inasmuch as there is no corresponding annular container groove provded in this embodiment of the invention, the annular lid bead 33 rests on the flat suface of the container just below the annular container bead 39 and is thus subjected to the deformation mentioned above. This exact combination is not shown in the drawings.

Figure 13:
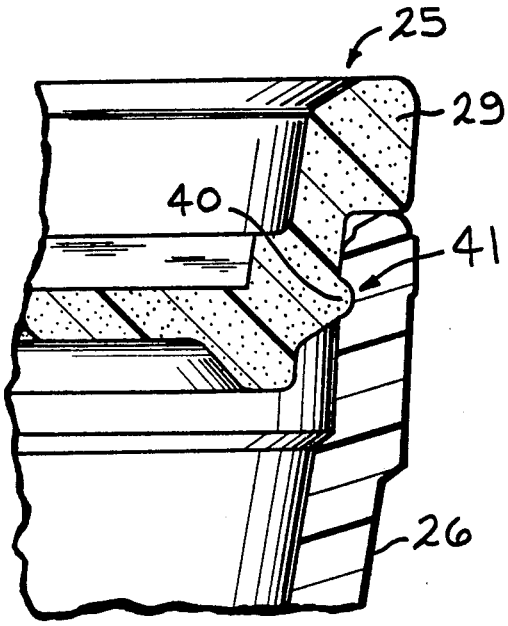
FIG. 13 is an enlarged partial schematic cross-sectional view of a modified embodiment of the interlocking lid and associated container in their interlocked position.

As shown in FIG. 13, another embodiment of the invention is to provide a lid 25 provided with only an annular lid bead 40 which matingly engages a container 26 having only a corresponding annular container groove 41.

Another embodiment of the invention is to provide a lid having only an annular lid bead portion 40 with no upper annular lid groove portion as shown in FIG. 13. However, this modified embodiment of the invention, the container 26 upon which the lid 25 is mounted so as to effect closure thereof is provided with a corresponding upper annular container bead 36 and lower annular container groove 37 as shown in the preferred embodiment of the invention shown in FIG. 11. As the lid 25 is moved into its fully closed position on the container 26, the annular lid bead 40 moves over the annular container groove 37. In this embodiment of the invention, the upper annular container bead 36 rests against the flat peripheral edge surface of the lid 25 immediatley above the annular lid bead 40, thus again being subjected to undesirable deformation.

Other various interlock configurations of lids and containers may be within the scope of the invention.

It should be noted that in the preferred embodiment of the invention the outer external circumferential diameter of the annular lip flange 29 of the lid 25 is slightly less than the outer circumferential diameter of the lip or rim portion 31 of the container 26. Thus, no portion of the lid or cover member 25 extends outwarldy from the cylindrical vertical plane established by the outer surface of the rim 31 of the container 26. Thus configured and positioned, the lid 25 is in effect recessed and does not extend to the outer peripheral edge of the lip or rim portion 31 of the container. However, it is considered to be within the scope of the invention that the lip flange 29 of the lid can be selectively extended to and even slightly beyond the outer peripheral edge of the rim 31 of the container 26, is so desired.

Thus, the lid 25 is not provided with an outer downwardly depending annular flange covering portion which extends downwardly over the rim portion in a covering realtionship downwardly along the outside of the container as is the case of some of the lids in the prior known art.

It has been found that the lids or covers of the prior art which have a flang eportin that extends downwardly over the exterior of the container upon which they are mounted are generally displaced or knocked off from their position on the container by inadvertent contact with adjacent containers or other objects while the closed container is being stored or carried, thus allowing the contents of the container to spill.

As shown in FIGS. 15 through 21, it is also within the scope of this invention that any of the foregoing embodiments of the invention can be selectively provided with a plurality of spaced apart vertical vent channels 42 provided in the outer peripheral side of the depressed central body portion 30 of the lid 25. A plurality of corresponding horizontally oriented radially outwardly extending vent channesl 43 are provided in the bottom surface of the outwardly extending lid lip flange 29 so as to be in open communication with the corresponding vertically-oriented vent channesl 42 provided along the outer vertical peripheral edge of the lip body portion 30.

Figure 15:
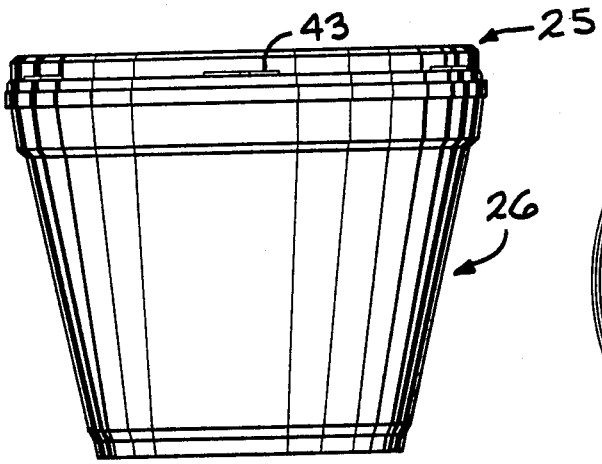
FIG. 15 is a side elevational view of another modified embodiment of the interlocking lid and associated container showing the vent channels provided therein.
Figure 16:
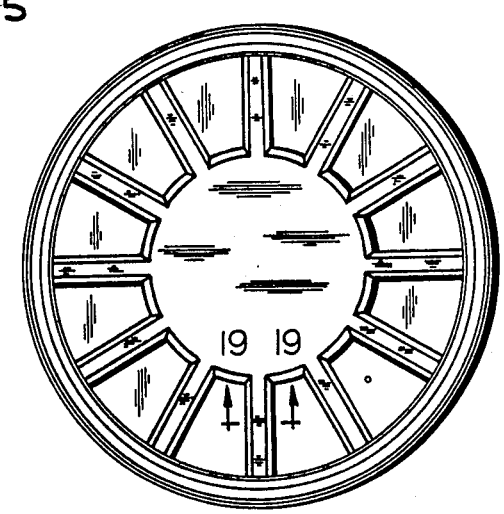
FIG. 16 is a top view of the modified embodiment of the interlocking lid shown in FIG. 15.
Figure 17:
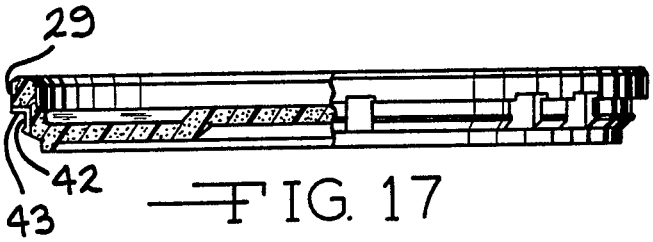
FIG. 17 is a side elevational view of the lid of the modified embodiment of the lid shown in FIG. 15 with a portion broken away to show the cross-sectional confiugration thereof and the vent channels provided thereon.
Figure 18:
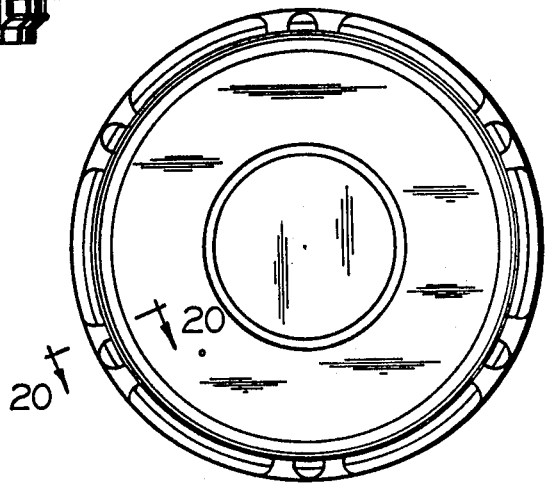
FIG. 18 is a bottom view of the modified embodiment of the lid shown in FIG. 17.
Figure 19:
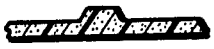
FIG. 19 is a partial cross-sectional view of the lid taken on line 19—19 of FIG. 16.
Figure 20:
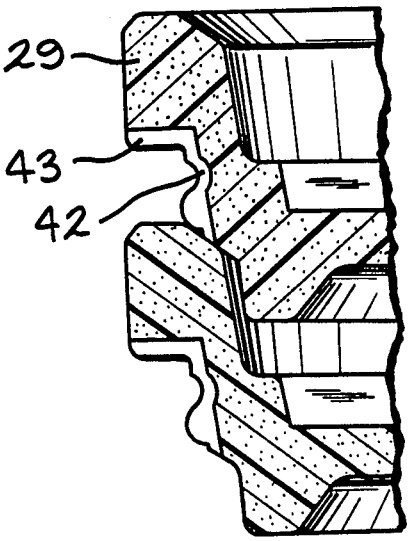
FIG. 20 is a partial schematic cross-sectional view showing a pair of the modified lids in a nestably stacked relationship as taken on line 20—20 of FIG. 18.
Figure 21:
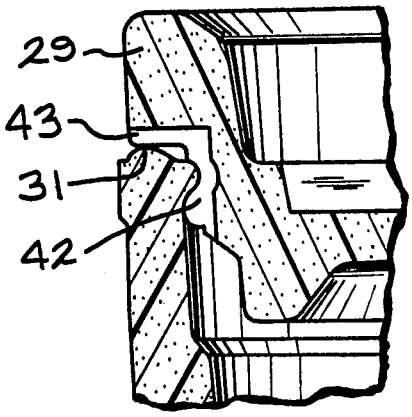
FIG. 21 is an enlarged partial schematic cross-sectional view showing the modified embodiment of the interlocking lid and associated container as shown in FIG. 15 and as taken on line 20—20 of FIG. 18 insofar as the lid is concerned.

As shown in FIGS. 15 and 21, in its operative use position, the modified lid provided with the above described vent channels is press-fitted into the opening of the container 26 so as to effect interlocked closure thereof as previously described herein. In this position, the annular lid lip flange 29 extends over the upper lip or rim 31 of the container 26 so that the lower surface of the lid lip flange 29 rests upon the upper portion of the container rim 31 of the container 26. As stated previously, the lid flange 39 selectively extends to the outer peripheral edge of the container 31 rim or it can stop just short thereof. With the lid 25 thus in its fully closed position the vent channesl 42 and 43, respectively, cooperate with the upper inner surface of the container 26 and the upper surface of the lip or rim 31 of the container to define a plurlaity of vent channel openings from the interior of the closed container to the outer atmosphere so as to effectively vent the contents of the container.

In the preferred embodiment of this embodiment of the invention, the vent channels are circumferentially equally spaced-apart in groups of two along the outer peripheral edge of the lid 25. Further, it is within the scope of the invention that the vent channels can be singly positioned around the lid in an equally spaced-apart manner or in groups of three or four or in any other desired spacing or grouping. It is also within the scope of the invention to provide a lid having a single vent channel formed by the combination of a single vertical channel 42 in open communication with a corresponding single horizontal channel 43 in aligned open communication therewith.

It is thus seen that a unique interlocking lid and associated container is provided having corresponding interlock means that are adapted to matingly engage upon covering engagement of the lid upon the container so as to provide positive interlock between lid and container. The unique cross-sectional configuration of the mating interlock means provided on the lid and container respectively, avoids damge to the foam annular lid interlock beam and to the corresponding foam annular container interlock bead by the provision of corresponding bead-receiving annular grooves on the lid and container respectively. The unique interlocking means have mating serpentine "S" configurations which provide positive interlock between "old" lids (i.e., higher shrinkage) and "new" containers (lower shrinkage).

Various other modifications of the invention may be made without departing from the principle thereof. Each of the modifications is to be considered as included in the hereafter appended claims, unless these claims by their language expressly provide otherwse.

I claim:

1. In an interlocking lid and associated container assembly formed from foamable styrofoam plastic and having first annular lid interlock means adapted for mating interlocking engagement with second annular container interlock means wherein the improvement comprises lid interlock means and mating container interlocking means which have a continuously curved serpentine "S" cross-sectional configuration specifically configured for use on lids and containers fabricated from styrofoam plastic so as to avoid crushing, breakage or deformation of the foamable styrofoam plastic interlock surfaces by avoiding flat bearing surfaces and complex interlocking structures used in interlocking lids and associated container assemblies fabricated from non-foamable hard plastic, the combination comprising:

a container having an upper peripheral rim edge defining an opening therein;

second annular container interlock means provided on the inside surface of said container proximate to the upper peripheral rim edge thereof;

a lid provided for covering locking engagement with said container, said lid provided with a downwardly depending central portion adapted for mating closure engagement into said opening defined by said upper peripheral rim edge of said container;

first annular lid interlock means provided on the outer peripheral side edge of said downwardly depending central portion of said lid, said first annular lid interlock means adapted for selective mating interlocking engagement with said second annular container interlock means so as to retain said lid in locked covering engagement with said container, said first annular lid interlock means comprise a lower annular raised lid bead portion and an upper annular lid groove portion so as to define a continuously curved serpentine "S" cross-sectional configuration and said second annular container interlock means comprise a corresponding upper annular raised container bead portion and lower annular container groove portion so as to define a corresponding continuously curved serpentine "S" cross-sectional configuration so as to matingly engage said first annular lid interlock means, said first and second interlock means characterized by elimination of any flat surfaces.

2. In the interlocking lid and associated container assembly of claim 1 wherein said lid is provided with an outwardly extending annular lip flange, said lip flange adapted for covering closure engagement with the upper surface of said upper peripheral rim edge of said container when said lid is in its closure position on said container.

3. In the interlocking lid and associated container of claim 2 wherein at least one or more vertically oriented vent channels are provided on the outer peripheral surface of said downwardly depending lid central portion, said lip flange provided with at least one or more corresponding horizontally oriented radially extending vent channels in the bottom surface thereof, said horizontally oriented radailly extending vent channels being in aligned open communication with said vertically oriented vent channels, said vertically oriented vent channels and said horizontally oriented vent channels cooperating with the upper portion of said container to form vent openings when said interlocking lid is in closure engagement with said container.

* * * * *